United States Patent [19]

Brandon

[11] Patent Number: 4,459,490

[45] Date of Patent: Jul. 10, 1984

[54] IDLE CONTROL SYSTEM FOR GENERATORS

[75] Inventor: George M. Brandon, Charlotte, N.C.

[73] Assignee: Textron Inc., R.I.

[21] Appl. No.: 420,386

[22] Filed: Sep. 20, 1982

[51] Int. Cl.[3] ..... F02D 29/06

[52] U.S. Cl. ..... 290/40 B; 290/51

[58] Field of Search ..... 290/40 R, 40 A, 40 B, 290/40 C, 40 F, 51

[56] References Cited

U.S. PATENT DOCUMENTS

| | | | |
|---|---|---|---|
| 3,192,394 | 6/1965 | Teter | 290/51 X |
| 3,612,892 | 10/1971 | Nobile et al. | 290/40 |
| 3,626,197 | 12/1971 | Zanzarella et al. | 290/40 C |
| 3,789,229 | 1/1974 | Jackson | 290/40 B X |
| 3,845,321 | 10/1974 | Santilli | 290/51 X |
| 4,074,145 | 2/1978 | Laffoon et al. | 290/40 R X |

*Primary Examiner*—B. Dobeck
*Assistant Examiner*—W. E. Duncanson, Jr.
*Attorney, Agent, or Firm*—Cushman, Darby & Cushman

[57] ABSTRACT

An internal combustion engine for driving a generator has a governor for maintaining the speed of the engine at a predetermined operating speed. An idle control circuit is provided for overriding the governor during no load conditions. This is accomplished by an electromagnetic coil controlled by a high sensitivity electronic switching element.

19 Claims, 3 Drawing Figures

IDLE CONTROL SYSTEM FOR GENERATORS

BACKGROUND OF THE INVENTION

Field of the Invention

The present invention relates to an idle control system for an internal combustion engine used to drive an electric generator.

Motor generator sets comprising an AC generator and an internal combustion drive engine are widely used. In general, idle control systems for controlling the speed of the drive engine are known. A speed responsive governor is utilized to maintain a relatively constant engine speed regardless of load, except during periods when there is no load on the generator. An idle control circuit detects the absence of a load on the generator and actuates an electronic device, such as a solenoid or an electromagnet, cooperating with the engine throttle to decrease the speed of the engine to a predetermined idle speed. Examples of such systems are described in U.S. Pat. Nos. 3,612,892 issued to Nobile et al on Oct. 12, 1971 and 3,626,197 issued to Zanzarella et al on Dec. 7, 1971, both commonly assigned with the present invention. The disclosures of such patents are herein incorporated by reference.

Such prior art idle control circuits, however, are disadvantageous in that they are relatively expensive both in terms of component costs, and power dissipation. In particular, the prior art idle circuits tend to dissipate power even when the electromagnet is not activated. An electronic switching device is used to short out the electromagnet coil when a current draw from the generator is sensed. The electromagnet is connected in series with a diode and a high power resistor (utilized to limit the current when the electromagnet coil is removed from the circuit). When the electronic switching device is rendered conductive, the current continues to flow through the current limiting resistor. Accordingly, the prior art circuits tend to dissipate on the order of 25 watts of power, and require appropriate provisions for heat removal.

Further, prior art systems for use with AC generators, such as described in the Nobile et al U.S. Pat. No. 3,612,892, utilize a current transformer having a primary winding interjected into the output line of the generator. Current drawn from the generator causes generation of a current in the secondary coil of the transformer, which is utilized to render the switching device conductive and short out the coil of the electromagnet. The primary coil of the transformer, however, requires a plurality of turns of relatively heavy (high gauge) magnet wire. The high gauge of the wire and requirement of a plurality of turns necessitates that the transformer be hand wound, and typically be connected to the other circuitry by hand.

SUMMARY OF THE INVENTION

The present invention provides an idle control circuit utilizing relatively inexpensive components, which are compatible with automatic assembly techniques, and which dissipate relatively little power. More particularly, a high sensitivity electronic switching element is rendered conductive upon the absence of a current draw from the generator to complete a current path through the idle control electromagnet coil. Since the current path is completed only when the electromagnet is activated, the high power resistor can be eliminated, and the power dissipation of the circuit is substantially reduced.

Further, in accordance with another aspect of the present invention, high sensitivity components are used to eliminate the necessity of a hand wound transformer.

In accordance of still another aspect of the present invention, a particularly advantageous transformer is utilized wherein the output line of the generator is utilized as the primary coil of the transformer.

BRIEF DESCRIPTION OF THE DRAWINGS

A preferred exemplary embodiment of the present invention will hereinafter be described in conjunction with the appended drawing, wherein like numerals denote like elements and.

DETAILED DESCRIPTION OF A PREFERRED EXEMPLARY EMBODIMENT

Figure 1:
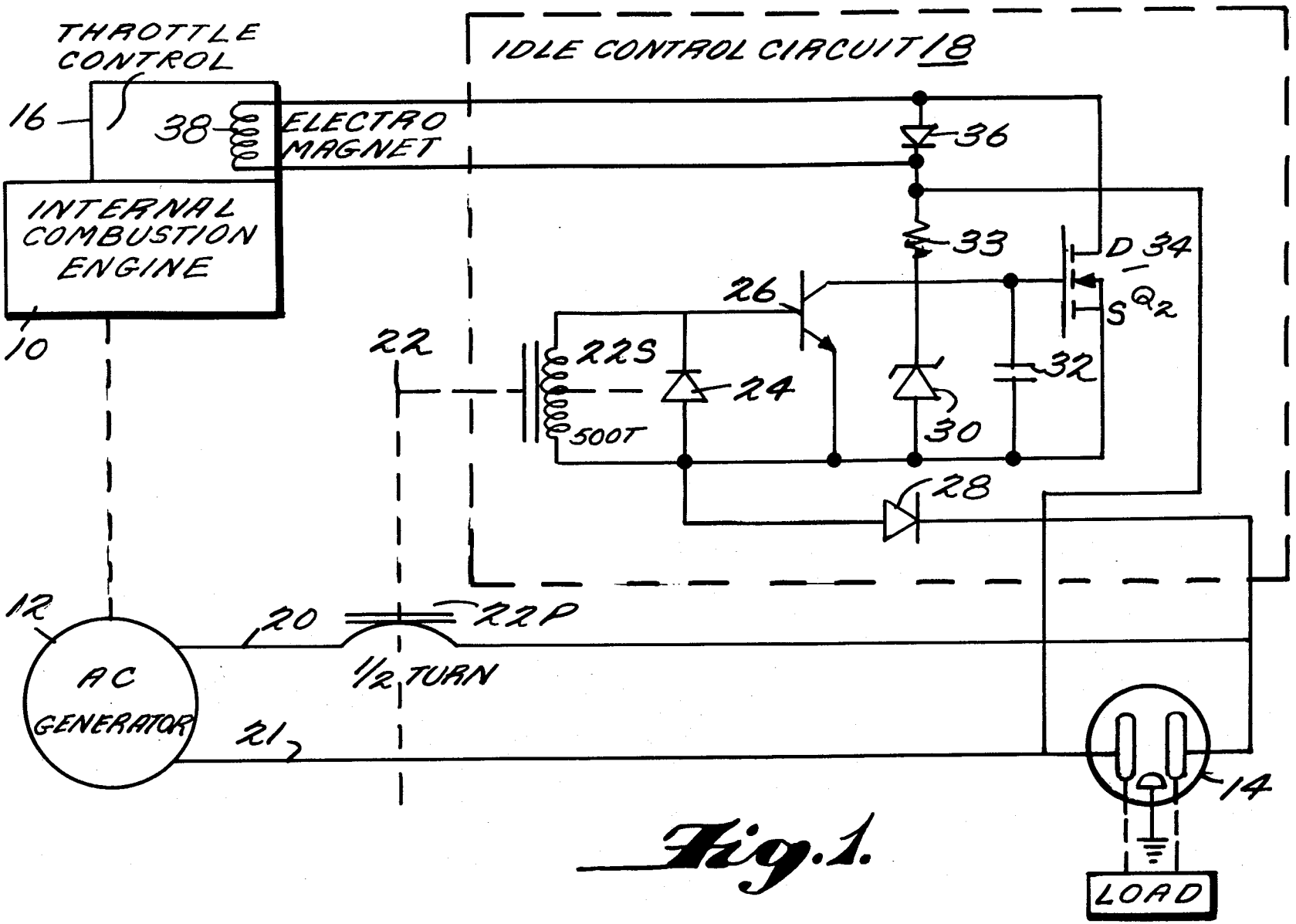
FIG. 1 is a block schematic diagram of an idle control system in accordance with the present invention.

Referring now to FIG. 1, a suitable internal combustion engine 10 is utilized to drive a conventional alternating current generator 12. Generator 12 provides AC power to one or more receptacles 14, through respective output lines 20 and 21. Typically, generator 12 provides both nominal 120 and 240 voltages at respective receptacles, and accordingly, includes more than one "hot" output line. However, only a single set of output lines is shown in FIG. 1 for the sake of simplicity. When a utilization device, such as a light or tool is "plugged" into receptacle 14, and is activated, a load on generator 12 is established. When no utilization device is drawing current from generator 12, a "no load" condition exists.

A suitable throttle control system 16 is provided to control the speed of internal combustion engine 10. Throttle control system 16 maintains engine 10 at a constant speed irrespective of the load on generator 12, except under "no load" conditions. During no load periods, throttle control system 16 automatically reduces the speed of the engine to a predetermined idle speed to save fuel, reduce noise level and increase equipment life. Briefly, throttle control system 16 typically includes a speed responsive governor for maintaining the constant engine speed which is overridden by a suitable electrically actuated device 38 cooperating with the throttle, in response to actuation signals from an idle control circuit 18. For a description of a suitable throttle control system reference is made to the aforementioned U.S. Pat. No. 3,612,892 to Nobile.

Idle control circuit 18 senses the absence of a load on generator 12, and generates an appropriate actuation signal to throttle control system 16. Idle control circuit 18 is inductively coupled to one output conductor 20 of generator 12 through a transformer 22. As will hereinafter be more fully explained in conjunction with FIG. 2, transformer 22 includes a primary coil 22P formed by conductor 20 and a secondary coil 22S, having a turns ratio of $\frac{1}{2}$ to 500. Where more than one set of output lines are provided, transformer 22 suitably includes a plurality of primary windings, one associated with each "hot" output line.

Secondary coil 22S generates a current indicative of the load condition of generator 12 to selectively render conductive an inverter transistor 26, suitably an NPN bipolar transistor such as a Motorola 2N4124. One terminal of secondary coil 22S is coupled to the base of transistor 26 and to the cathode of a diode 24. The other terminal of secondary coil 22S is connected to the anode of diode 24, the emitter of transistor 26 and the anode of another diode 28. The cathode of diode 28 is connected to conductor 20.

Inverter transistor 26 is utilized to selectively render non-conductive a suitable switching transistor 34, such as an International rectifier IRF713 HEXFET during periods when a load is present on generator 12. The collector of transistor 26 is connected to the gate of FET 34, together with a biasing circuit comprising a zener diode 30, a capacitor 32, and a resistor 33. Zener diode 30 is suitable a Motorola IN5242 diode having a zener voltage of 12 V and a power rating of ½ watt. Capacitor 32 and resistor 33 are suitably of values, 1 microfarad (1 μf) and 1 megaohm (1 MΩ), respectively. The cathode of zener diode 30, one terminal of a capacitor 32 and one terminal of resistor 33 are connected to the gate of FET 34. The anode of zener diode 30, the second terminal of capacitor 32 and the source electrode of FET 34 are all connected to the emitter of transistor 26.

Zener diode 30, capacitor 32 and resistor 33 cooperate to derive a regulated DC voltage (equal to the zener voltage) from AC generator 12, which is selectively provided as a control voltage at the gate of FET 34. A direct current path is provided through resistor 33, the parallel combination of zener diode 30 and capacitor 32, and diode 28. Diode 28 blocks the reverse current flow, and, a half wave rectified current is therefor provided to charge capacitor 32. The RC time constant is chosen, as will be explained, such that the period necessary to charge capacitor 30 to the threshold (switching) voltage of FET 34 (e.g. 4 V) is greater than one half cycle of the AC current provided by generator 12. Zener diode 30, operates as a voltage regulator, to protect FET 34 from excessive voltage. More particularly, zener diode 30, coupled across capacitor 32, prevents capacitor 32 from accumulating a voltage greater than the zener voltage. The maximum voltage provided at the gate of FET 34 is therefore limited to the zener voltage. The zener voltage (e.g. 12 V) is chosen to be within the rating of FET 34, but sufficiently high to render FET 34 conductive.

FET 34 is utilized to selectively provide a current path for actuation device 38. The drain of FET 34 is connected to one side of the actuation device (e.g. electromagnet coil) in throttle control 16. The other side of the actuation device is connected to the neutral conductor 21 of generator 12. Accordingly, FET 34 selectively completes a current path through electromagnet coil 38, FET 34 and diode 28. The half wave rectified current flow actuates the idle control mechanism to place engine 10 in idle mode. A diode 36 is connected in parallel with actuation device 38, with anode coupled to the drain of FET 34. Diode 36 is utilized as a free wheeling diode to protect FET 34 from voltage transcients caused by electromagnet coil 38 when FET 34 is turned off. If desired, a capacitor (not shown) can be connected in parallel with coil 38 to filter the half wave rectified signal to coil 38.

In operation, when a load is drawn from generator 12, FET 34 is rendered non-conductive to disrupt the current path to electromagnet coil 38. A load provided on generator 12 draws an AC current through primary coil 22P, causing a concomitant current to be generated through secondary coil 22S. The current from secondary coil 22S is applied to the base of transistor 26. Diode 24 provides a path for reverse current flow from secondary 22S during the negative half-cycle of the output current and thus protects transistor 26 from damage due to reverse current flow. Transistor 26 is thus rendered conductive during each positive half cycle of the AC current. When conductive, transistor 26, provides a shunt bypass, discharging capacitor 32. The voltage applied to the gate of FET 34 is thus reduced to a low value and FET 34 is rendered nonconductive. Transistor 26 is non-conductive during the negative half-cycles of the AC current, and capacitor 32 begins to accumulate a charge. However, the RC time constant of resistor 33 and capacitor 32 is chosen such that transistor 26 is rendered conductive by the next successive positive half-cycle of current and discharges capacitor 32 prior to capacitor 32 accumulating a sufficient voltage (e.g. 4 V) to render FET 34 conductive. Current flow through the electromagnet coil 38 is therefore inhibited and the throttle control operates to maintain the engine speed at the designated operating level.

When, however, a "no load" condition exists, no AC current flows through primary coil 22P. Accordingly, secondary coil 22S generates no current and transistor 26 is rendered non-conductive. Capacitor 32 thus charges to the zener voltage, which is applied at the gate of FET 34 to render the FET conductive, and complete a current path through coil 38 of the actuation device. Thus, in the absence of a load on generator 12, the actuation device is tripped, and engine 10 is maintained at a predetermined idle speed.

The use of a high sensitivity inverter transistor 26 (i.e. rendered conductive by a low magnitude current such as on the order of 6 microamperes), permits the use of a particularly simple output sensing transformer 22, wherein the primary coil is formed by the output line of the generator itself. Such a transformer is shown in FIGS. 2 and 3.

Figure 2:
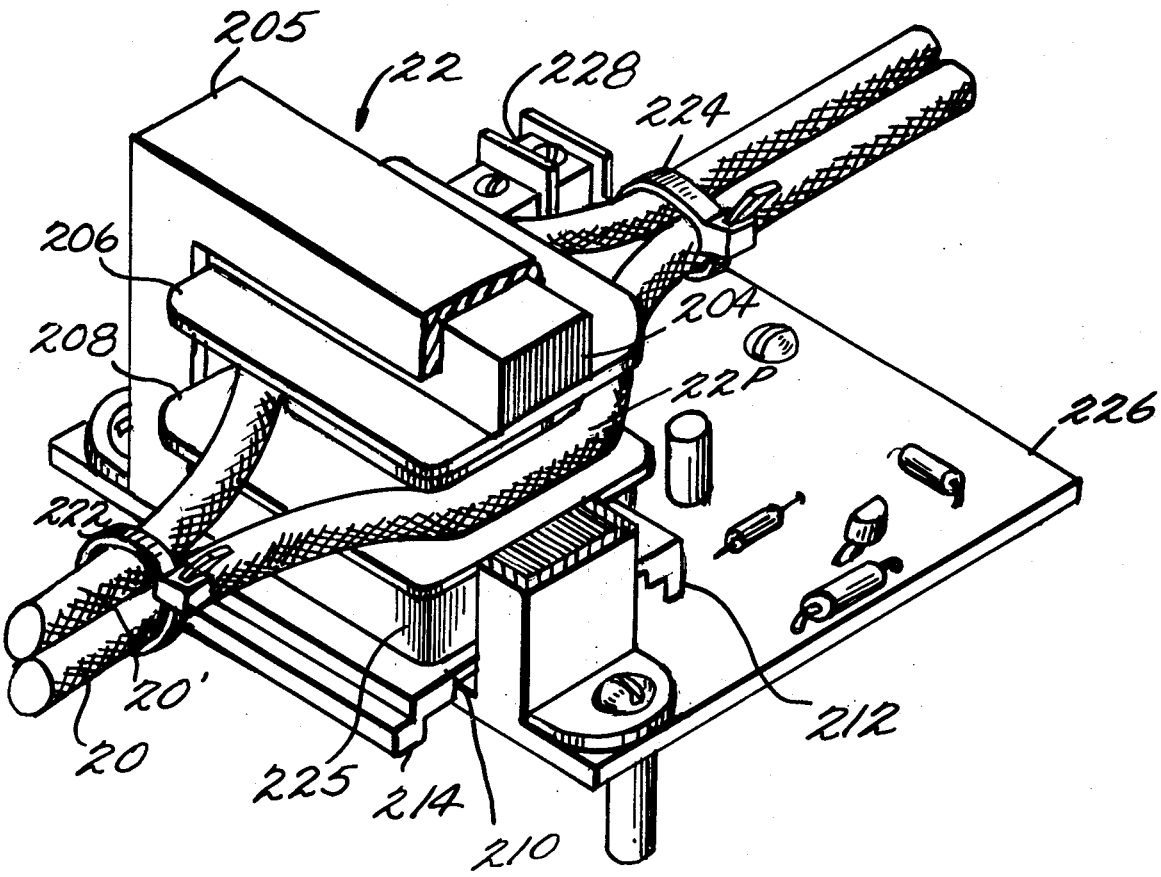
FIG. 2 is a partially cut away pictorial diagram of a transformer for use with the circuit of the present invention.
Figure 3:
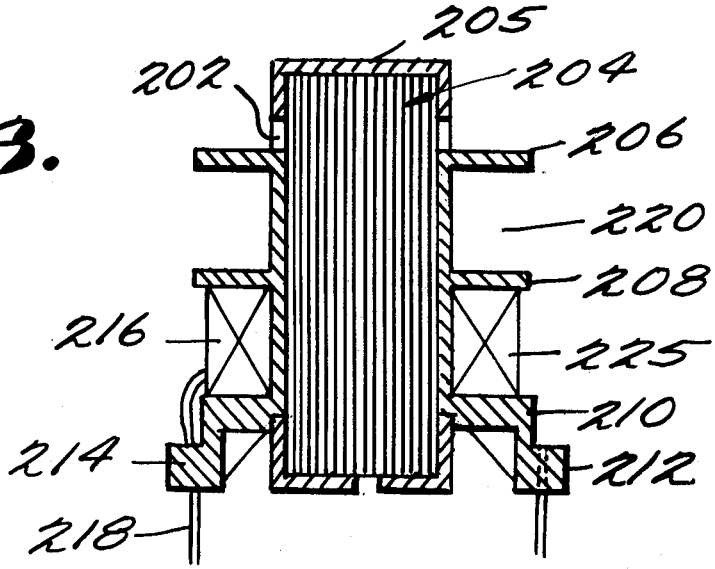
FIG. 3 is a sectional elevation view of the transformer of FIG. 2.

Referring to FIGS. 2 and 3, transformer 22 suitably comprises a nylon bobbin 202, encompassing the center leg of a laminated core 204 (FIG. 3). Core 204 suitably comprises a ½ inch stack of 0.014 inch thick ANSI grade designation M-6 laminations. Bobbin 202 and core 204 are disposed within a conventional transformer channel frame 205, conforming to the periphery of core 204. Bobbin 202 suitably includes top, middle, and bottom projecting platforms 206, 208, and 210. Bottom platform 210 includes respective feet 212 and 214, peripherally disposed on two sides thereof.

Platforms 208 and 210 form a cavity 216 therebetween, in which secondary coil 22S is wound. Secondary coil 22S suitably comprises 500 turns of No. 32 magnet wire, taped to prevent contact with the laminations of core 204. Secondary coil 22S is terminated on terminals 218, secured in and projecting through foot 214.

Platforms 306 and 208 form a cavity 220, through one side of which generator output line conductor 20 is passed to form the ½ turn primary coil 22P. In practice generator 12 typically includes two sets of output lines. Accordingly, a second ½ turn primary coil (not shown in FIG. 1) is formed by passing a conductor 20′ from the second set of output lines through a second (opposite) sides of cavity 220. A current in either or both conductors 20 and 20' induces a current in secondary coil 22S. The respective conductors 20 and 20' are then secured in position by respective conventional cable straps 222 and 224.

The elimination of a pre-formed heavy gauge primary coil, enables formation of transformer using conventional automatic winding techniques. Further, the use of ½ turn primary coils permits two primary coils to be accommodated using a relatively simple structure.

Transformer 22 is also compatible with automatic insertion machines, eliminating the necessity of manual assembly. Channel frame 205 is secured to a printed circuit (PC) board 226, bearing, and electrically interconnecting, the remaining components of circuit 18. Terminals 218 project through respective corresponding holes in PC board 226, and are soldered into the circuitry. A terminal block 228 is provided to facilitate connection of circuit 18 to the receptacles 14 and actuation device coil 38.

From the foregoing, it is apparent that the present invention provides a particularly advantageous idle control circuit. The use of inverter transistor 26 to provide control signals to a high power switching device (FET 34) eliminates the necessity of a current limiting power resistor resulting in substantial reduction in power dissipation, while at the same time increasing the efficiency of the actuation device.

Since current flows in the actuation device path only during periods that coil 38 is in the circuit, no high power current limiting resistor is necessary as in the prior art circuits. The elimination of the relatively costly power resistor not only reduces the cost of circuit 18, but reduces the power dissipated by the circuit from on the order of 25 watts in the prior art circuits to on the order of ¼ watt. At the same time elimination of the power resistor permits a higher magnitude current through electromagnet coil 38, enhancing the operation of the activation device. Further, use of a high sensitivity device such as inverter transistor 26, to generate the control signals to the high power switching device eliminates the necessity of a complex, high power transformer, substantially decreasing the cost of circuit 18 and permitting circuit 18 to be assembled using conventional automated techniques.

It will be understood that the above description is of a preferred exemplary embodiment of the present invention, and that the invention is not limited to the specific forms shown. Modifications may be made in the design and arrangement of the elements without departing from the spirit of the invention as expressed in the appended claims.

What is claimed is:

1. Apparatus comprising:

a generator adapted for providing AC signals through at least first and second output conductors to a variable and intermittent load;

an internal combustion engine for driving said generator;

governor means for maintaining the speed of said engine at a predetermined operating speed;

electromagnetically operable means for selectively overriding said governor means and maintaining the speed of said engine at a predetermined idle speed; and a control circuit for selectively actuating said electromagnetically operable means during no load conditions of said generator, said control circuit comprising;

rectifier means coupled to said first output conductor, for providing an at least partially rectified signal;

a switching means responsive to application of a control voltage higher than a predetermined threshold value, for selectively completing a current path between said rectifier means and second output conductors through said electromagnetically operable means, accumulator means, responsive to said rectified signal for controllably accumulating a voltage in accordance with a predetermined time constant, said time constant being such that less than said threshold voltage is accumulated during a half-cycle of said AC signals, said accumulated voltage being applied to said switching means as said control signal;

transformer means, including a secondary winding, for inducing a current in said secondary winding in response to current passing through said first output conductor; and inverter means; including an inverter transistor connected such that said inverter transistor is rendered conductive in response to half-cycles of said induced current of a first polarity, for selectively discharging said accumulator means in response to said induced current.

2. The apparatus of claim 1 wherein said rectifier means comprises a first diode.

3. The apparatus of claims 1 or 2 wherein said switching means comprises a field effect transistor.

4. The apparatus of claim 1 wherein said accumulator means comprises a resistor and capacitor.

5. The apparatus of claim 2 wherein said accumulator means comprises a resistor and a capacitor serially connected between said first diode and said second output conductor.

6. The apparatus of claim 5 wherein said accumulator means further comprises a zener diode connected in parallel with said capacitor.

7. The apparatus of claim 4, 5 or 6 wherein said switching means comprises a field effect transistor.

8. The apparatus of claims 1, 2, 4, 5 or 6 wherein said transformer means includes means, adapted to receive said first output conductor, for disposing said first output conductor in inductive relation to said secondary winding.

9. The apparatus of claim 8 wherein said switching means comprises a field effect transistor.

10. The apparatus of claims 1, 2, 4, 5 or 6 wherein said circuit further comprises a freewheeling diode connecting in parallel with said electromagnetically operable means.

11. An idle control circuit, adapted for connection to a control mechanism of an internal combustion drive engine cooperating with an AC generator for actuating said control mechanism in response to no-load conditions on the output lines of said generator, said circuit comprising:

transformer means, including a secondary winding for inducing a current in said second winding in response to a current in said generator output lines;

a first diode, coupled to one of said generator output lines;

an FET, responsive to a control voltage applied thereto, connected to selectively complete a current path between said first diode and a second generator output line through said control mechanism when said control voltage exceeds a predetermined voltage;

a resistor and capacitor serially coupled between said first diode and said second generator output line, such that said capacitor accumulates a voltage in accordance with a predetermined AC time constant, said accumulated voltage being applied as said control signal to said FET, said time constant being such that said capacitor accumulates less than said predetermined voltage during one half-cycle of said induced current;

an inverter transistor and a second diode connected such that said inverter transistor is rendered conductive during predetermined polarity half-cycles of said induced current, to selectively discharge said capacitor.

12. The circuit of claim 11 further including a zener diode connected in parallel with said capacitor.

13. The circuit of claim 11 or 12 further including a third diode, adapted for connection in parallel with said control mechanism.

14. The circuit of claim 11 wherein said transformer means includes means for disposing said first generator output line in inductive relation to said secondary winding.

15. The apparatus of claim 11 wherein said transformer means comprises;

a magnetizable core;

a bobbin disposed about a portion of said core, said bobbin including a first portion about which said secondary winding is wound, and a second portion for recieving said first generator output line, whereby said first generator output line forms a primary winding.

16. In a system of the type including a generator adapted for operation under varying load conditions, an internal combustion engine for driving said generator, throttle control means, cooperating with said engine, for controlling the speed of said engine, said throttle control means including actuation means, responsive to actuation signals applied thereto, for maintaining said engine at a predetermined idle speed for the duration of said actuation signals; and idle control means for generating said actuation signal during no-load operating conditions of said generator, the improvement wherein said idle control means comprises:

switching means, responsive to control signals applied thereto, for selectively applying said actuation signals to said throttle control means;

biasing means for selectively generating a control signal to said switching means to effect application of said actuation signals;

means for generating a load signal indicative of a load drawn from said generator;

inverter means, responsive to said draw signal, for disabling said biasing means during periods of load on said generator to inhibit generation of said actuation signals.

17. The system of claim 16 wherein said generator is an AC generator and:

said means for generating a load signal comprises a transformer;

said inverter means comprises a first transistor, including first and second elements defining a controlled current path therebetween and a control element for controlling current flow through said current path, and a diode, electrically connected between said first transistor control and second elements, said draw signal being applied to said control element such that said first transistor current path is rendered conductive during half cycles of a predetermined polarity of AC signals generated by said generator;

said biasing means comprises a half wave rectifier, a resistance and a capacitance, said half wave rectifier providing signals through said resistance to charge said capacitor, in accordance with an RC time constant such that said capacitor accumulates less than a predetermined voltage during one half cycle of said AC signal; and said switching means comprises a second transistor having first and second elements defining a controlled current path therebetween, and a control element for controlling current flow through said current path, said second transistor first and second elements being electrically connected to controllably complete a current path through said actuation means, said second transistor control element being responsive to the voltage accumulated by said capacitance and rendering said second transistor current path conductive in response to application of a voltage equal to at least said predetermined voltage to said control element, said first transistor being connected to selectively discharge said capacitance.

18. The system of claim 17 wherein said biasing means further comprises a zener diode coupled in parallel with said capacitance.

19. The system of claim 17 wherein said transformer includes at least one primary winding and a secondary winding and comprises:

a magnetizable core;

a bobbin disposed about a portion of said core, said bobbin including a first portion about which said secondary winding is wound; and a second portion adapted to receive a conductor through which current drawn from said generator passes, whereby said conductor forms said primary winding.

* * * * *